United States Patent [19]

Petersson

[11] 4,046,447

[45] Sept. 6, 1977

[54] CONTACT DEVICE

[75] Inventor: Jan Ake Sigfrid Petersson, Solna, Sweden

[73] Assignee: Telefonaktiebolaget L M Ericsson, Stockholm, Sweden

[21] Appl. No.: 629,099

[22] Filed: Nov. 5, 1975

[30] Foreign Application Priority Data

Nov. 26, 1974 Sweden ..... 7414824

[51] Int. Cl.[2] ..... H01R 13/58

[52] U.S. Cl. ..... 339/103 M; 200/275

[58] Field of Search ..... 339/103 M, 103 R, 101; 200/275

[56] References Cited

U.S. PATENT DOCUMENTS 3,718,888 2/1973 Pasternak ..... 339/103 M X

*Primary Examiner*—Roy Lake
*Assistant Examiner*—DeWalden W. Jones
*Attorney, Agent, or Firm*—Hane, Sullivan & Spiecens

[57] ABSTRACT

A connector for a plurality of contact parts which are arrayed next to each other in a plane are supported by a planar shell of insulating material. A removable cap is provided with a plurality of receptacles for the free ends of the contact parts with a border edge resting tightly against a corresponding border edge of the shell. The border edge of the shell is shaped with a meander-formed border line to permit passage of wires. The cap is shaped like a flexible clamp which stretches over the plane shell and is attached by elastic engagement at the end of the shell.

2 Claims, 5 Drawing Figures

CONTACT DEVICE

The present invention refers to a contact device and more precisely to a connector having a plurality of contact parts each comprising for example a U-formed, straight groove. The contact parts with their U-formed grooves are assembled next to each other in one plane in an isolating plane shell. The characteristics of a contact device formed in accordance with the present invention are defined by the appended claims.

The invention will be described more in detail in connection with the accompanying drawing where FIG. 1 shows the connector from the side;

Figure 1:
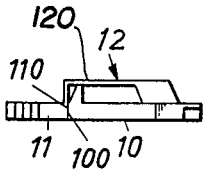
Figure 2:
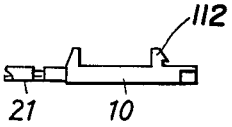
FIG. 2 shows only the shell with inserted contact parts from the side.
Figure 3:
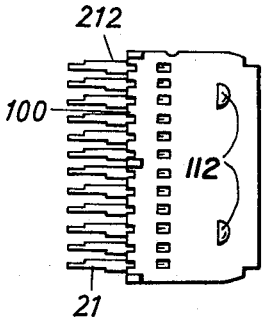
FIG. 3 shows the arrangement according to FIG. 2 from above.
Figure 4:
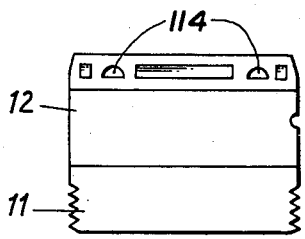
FIG. 4 shows a cap included in the contact device from above.
Figure 5:
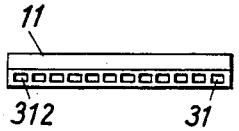
FIG. 5 shows the cap from the front.

The arrangement as shown in FIG. 1 comprises a plane shell 10 and a plane cap 11. In the shell 10 are assembled and inserted a number of contact parts each comprising a U-formed straight groove. The free ends of the contact parts protruding from the shell 10, see FIGS. 2 and 3 where they are designated 21 . . . 212, are inserted in receptacles or boxes in the cap 11 designated 31 . . . 312. In mounted state one border edge 110 of the cap 11 abuts tightly against a corresponding border edge 100 of the shell 10. The border edge 100 is shaped with a meandering periphery in front of the receptacles of the shell intended for the contact parts. Thus leads or wires soldered in the contact parts can be led out of the device via such cuts and the free space between the shell 10 and the cap 11. A clamp 12 which is formed in one piece with the plane part 120 of the cap 11, is flexible and stretches over the plane shell 10 and is attached by elastic engagement at the end of the shell. The elastic engagement means comprises hooked studs 112 extending upward from the plane of the shell 11 and the openings 114 in clamp 12.

It is possible that instead of the edge 100 of the shell being meandered, the edge 110 of the cap is shaped with such cuts. In addition there can be co-operating cuts on both edges 100 and 110 possible, which solution, however, probably is not preferable.

It has been shown that the present embodiment provides a contact device which compared to earlier constructions is more compact and thus is easier adapted to different systems, is more suitable with consideration to the risks of fire, and is cheaper in manufacture.

We claim:

1. A connector comprising a planar shell (10) of insulating material, a plurality of adjacent and parallel contact pins (21) fixed in said planar shell, each of said pins extending beyond a first edge (100) of said planar shell, a cap (11), one end of said cap being provided with a plurality of open-through passageways (312) for accommodating said contact pins, a first edge (110) of said cap abutting said first edge of said planar shell, one of said first edges being provided with cutouts for exposing along the abutting region a portion of each contact pin whereby access is provided for attaching signal leads to said contact pins, the ends of said through passageways remote from said first edges being open wherein electrical connections can be made via said passageways to said contact pins, said cap having a flexible clamp member (12) extending from said first edge of said cap displaced from and parallel to said plane shell in a direction opposite to said contact pins, and interengaging means near the end of said flexible clamp member and said plane shell remote from said contact pins for removably connecting said cap to said plane shell.

2. The connector of claim 1 wherein said interengaging means includes a hooked stud (112) extending upward from said shell and an opening (114) in said flexible clamp member for receiving said hooked stud.

* * * * *